United States Patent [19]

Fiedler et al.

[11] 4,123,299

[45] Oct. 31, 1978

[54] METHOD OF PRODUCING SILICON-IRON SHEET MATERAL, AND PRODUCT

[75] Inventors: Howard C. Fiedler, Schenectady, N.Y.; Joseph T. Cohen

[73] Assignee: General Electric Company, Schenectady, N.Y.

[21] Appl. No.: 837,505

[22] Filed: Sep. 29, 1978

[51] Int. Cl.[2] ..... H01F 1/04

[52] U.S. Cl. ..... 148/111; 75/123 L; 148/31.55; 148/112; 148/113

[58] Field of Search ..... 75/123 L; 148/111, 112, 148/113, 31.55

[56] References Cited

U.S. PATENT DOCUMENTS

| | | | |
|---|---|---|---|
| 3,239,332 | 3/1966 | Goss | 148/111 |
| 3,278,346 | 10/1966 | Goss | 148/31.55 |
| 3,770,517 | 11/1973 | Gray et al. | 148/31.55 |

*Primary Examiner*—W. Stallard

*Attorney, Agent, or Firm*—Charles T. Watts

[57] ABSTRACT

The magnetic properties of silicon-iron are improved by adding tin, and by both adding tin and lowering the sulfur content the weld brittleness is reduced in addition to improving the magnetic properties.

9 Claims, 5 Drawing Figures

METHOD OF PRODUCING SILICON-IRON SHEET MATERAL, AND PRODUCT

The present invention relates generally to the art of producing electrical steel and is more particularly concerned with a novel method of producing singly oriented silicon-iron sheet having both good weldability characteristics and excellent magnetic properties, and is also concerned with the resulting new product.

CROSS REFERENCE

This invention is related to the invention disclosed and claimed in U.S. patent application Ser. No. 837,504 filed of even date herewith and assigned to the assignee hereof and directed to the novel concept of limiting sulfur content of silicon-iron to not more than 0.018 percent and using copper as a partial substitute for sulfur as a grain growth inhibitor during the final anneal and thereby reducing or eliminating weld brittleness while retaining excellent magnetic properties in the resulting product.

BACKGROUND OF THE INVENTION

The sheet materials to which this invention is directed are usually referred to in the art as "electrical" silicon steels or, more properly, silicon-irons and are ordinarily composed principally of iron alloy with about 2.2 to 4.5 percent silicon and relatively minor amounts of various impurities and very small amounts of carbon. These products are of the "cube-on-edge" type, more than about 70 percent of their crystal structure being oriented in the (110) [001] texture, as described in Miller Indices terms.

Such grain-oriented silicon-iron sheet products are currently made commercially by the sequence of hot rolling, heat treating, cold rolling, heat treating, again cold rolling and then final heat treating to decarburize, desulfurize and recrystallize. Ingots are conventionally hot-worked into a strip or sheet-like configuration less than 0.150 inch in thickness, referred to as "hot-rolled band." The hot-rolled band is then cold rolled with appropriate intermediate annealing treatment to the finished sheet or strip thickness usually involving at least a 50 percent reduction in thickness, and given a final or texture-producing annealing treatment. As an alternative practice, set forth, for example, in my U.S. Pat. No. 3,957,546, assigned to the assignee hereof, the hot-rolled band is cold rolled directly to final gauge thickness.

In these boron- and nitrogen-containing silicon-irons, strong restraint to normal grain growth and thus promotion of secondary recrystallization to a precise (110) [001] grain orientation is the result of controlling the ranges of these constituents. The sulfur effective for this purpose is that which is not combined with strong sulfide-forming elements such as manganese, a presently unavoidable impurity in iron and steel. Thus, the total sulfur is necessarily greater than that necessary to provide its grain growth inhibition effect.

It is also generally recognized in the art that the presence of high total sulfur and a small quantity of boron can lead to marked brittleness in welds made in the silicon-iron alloy. Because of this weld brittleness, it has not been generally possible to weld two hot rolled coils together for cold rolling as would be a desirable operating practice since reducing the sulfur content for that purpose would have the result of degrading the magnetic properties of the metal. Having that choice usually means foregoing the advantage of good weldability.

SUMMARY OF THE INVENTION

I have discovered that in certain silicon-iron heats containing boron and nitrogen the sulfur requirement for grain growth inhibition can be met to a greater or lesser degree through the use of tin. Further, I found that tin additions for that purpose do not increase weld brittleness and that the magnetic properties are superior to those of higher sulfur heats without tin. In other words, I have discovered how, through the use of tin, to produce heats having magnetic properties excelling those associated with high sulfur content and having the desirable weld characteristics associated with low sulfur content.

Specifically, I have found that the foregoing new results can be consistently achieved by adding up to 0.10 percent tin to alloys containing as little as 0.010 percent sulfur, the amount of tin required being greater the lower the sulfur content.

Another finding that I have made is that magnetic properties can be still further enhanced in silicon-iron to which tin has thus been added by applying the boron-containing coating to the cold rolled silicon-iron sheet prior to the final heat treatment.

The initial hot rolling temperature has likewise been found to have a noticeable effect on permeability in these tin-addition silicon-iron alloys. Thus, sheets of the foregoing composition hot rolled from 1200°-1300° C consistently have higher permeability than those hot rolled from 1100°-1150° C.

In view of these several discoveries of mine, those skilled in the art will understand that this invention has both method and product aspects. The product is a cold rolled sheet containing boron, nitrogen, sulfur and tin in controlled amounts enabling development of desired magnetic properties and weldability in the finished sheet material. The product by which the sheet material is produced is likewise novel, particularly in the relation between the sulfur and tin contents.

Briefly described, in its article aspect this invention takes the form of a cold rolled silicon-iron sheet product containing 2.2 to 4.5 percent silicon and from three to 35 parts per million boron, from 30 to 75 ppm nitrogen in the above stated ratio range of boron, from 0.02 to 0.05 percent manganese, 0.005 to 0.025 percent sulfur and tin in amounts ranging from 0.01 to 0.10 percent, with the highest tin content being associated with the lowest sulfur content.

Similarly described, the method of this invention comprises the steps of providing a silicon-iron melt for the foregoing composition, casting the melt and hot rolling the resulting billet to produce a sheet-like body, cold rolling the hot rolled body to provide a sheet of final gauge thickness, and subjecting the resulting cold rolled sheet to a heat treatment to decarburize it and develop (110) [001] secondary recrystallization in it.

DETAILED DESCRIPTION OF THE INVENTION

Figure 1:
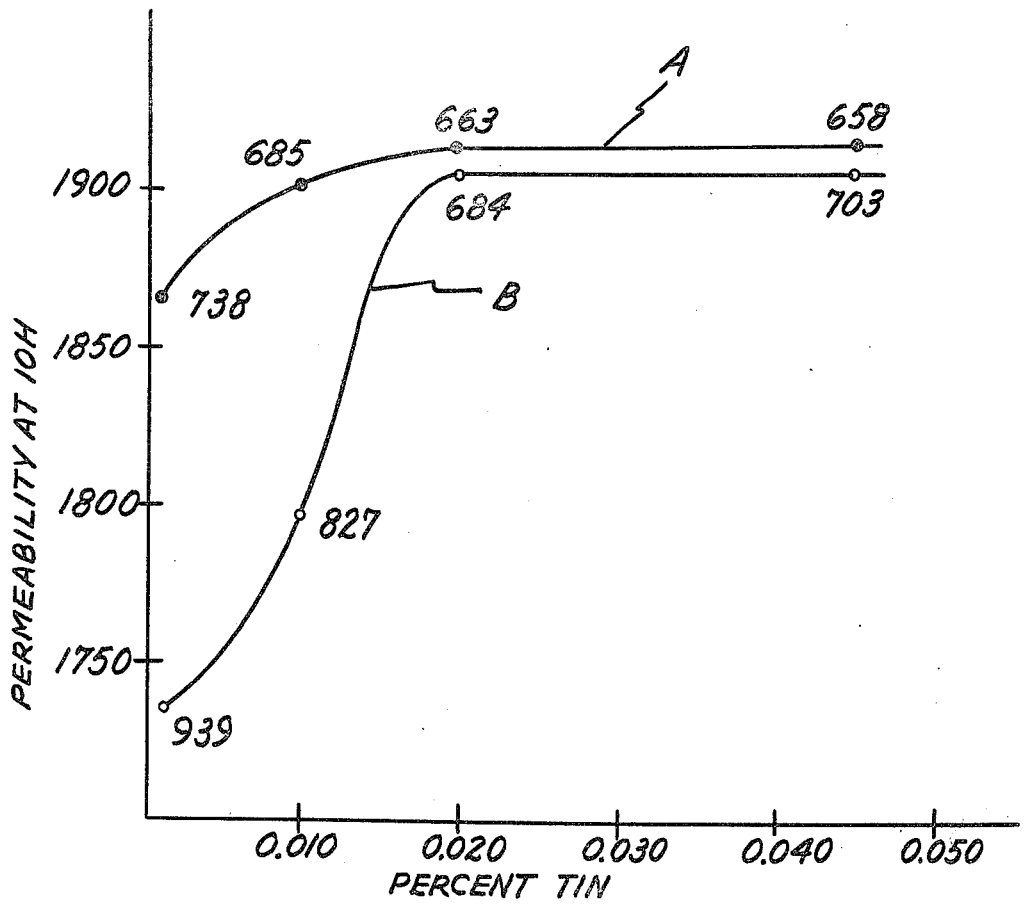
FIG. 1 shows the effects of tin on the permeability and the 60 Hertz losses at 17 kB.

In carrying out this invention, one may provide the cold-rolled sheet product described above by preparing a silicon-iron melt of the required chemistry, and then casting and hot rolling to intermediate thickness. Thus, the melt on pouring will contain from 2.2 to 4.5 percent silicon, from about three to 35 ppm boron and about 30 to 90 ppm nitrogen in the ratio range to boron of 1 to 15 parts to 1, manganese from 0.02 to 0.05 percent, and sulfur and tin in the ranges stated above, the remainder being iron and small amounts of incidental impurities. Following anneal, the hot band is cold rolled with or without intermediate anneal to final gauge thickness and then decarburized.

The resulting fine-grained, primary recrystallized, silicon-iron sheet product in whatever manner produced is provided with a magnesia coating for the final texture-developing anneal. Preferably, the coating step is accomplished electrolytically as described in U.S. Pat. No. 3,054,732, referenced above, a uniform coating of $Mg(OH)_2$ about 0.5 mil thick thereby being applied to the sheet. Boron may be incorporated in the resulting coating in the amount and for the purpose stated above by dipping the coated strips in aqueous boric acid solution or the like.

As the final step of the process of this invention, the thus-coated sheet is heated in hydrogen to cause secondary grain growth which begins at about 950° C. As the temperature is raised at about 50° C per hour to 1000° C, the recrystallization process is completed and heating may be carried on to up to 1175° C if desired to insure complete removal of residual carbon, sulfur and nitrogen.

The following illustrative, but not limiting, examples of my novel process as actually carried out with the new results indicated above will further inform those skilled in the art of the nature and special utility of this invention.

EXAMPLE I

Four laboratory heats were melted in an air induction furnace under an argon cover using electrolytic iron and 98 percent ferrosilicon, all containing 3.1 percent silicon, 0.025 percent manganese, 0.012 percent sulfur, 5–10 parts per million boron, 45–75 parts per million nitrogen, 0.10 percent copper and 0.035 percent chromium. Tin was added in different amounts to the separate heats to provide a range of tin content from 0.002–0.045 percent. Compositions of these heats, as analyzed, are set out in Table I:

TABLE I

| Heat | % Mn | % S | Mn/S | % Sn | ppm N |
|---|---|---|---|---|---|
| 1 | 0.025 | 0.012 | 2.0 | 0.002 | 69 |
| 2 | 0.024 | 0.012 | 2.0 | 0.010 | 74 |
| 3 | 0.026 | 0.012 | 2.1 | 0.020 | 46 |
| 4 | 0.025 | 0.011 | 2.3 | 0.045 | 49 |

Slices 1.75 inch thick were cut from ingots cast from these melts and were hot rolled from 1250° C in six passes to a thickness of about 90 mils. Following pickling, the hot band samples were heat treated at 950° C, the time between 930° and 950° C being about 3 minutes. The hot bands were then cold rolled directly to 11 mils final gauge thickness. Then Epstein-size strips of the cold-rolled material were decarburized to less than 0.006 percent by heating for 2 minutes at 800° C in 20° C dew point hydrogen. With 0.10 percent tin, the carbon level after the decarburization heat treatment is approximately 0.010 percent. This leads to higher losses but does not affect permeability. Lower carbon levels and losses may be achieved through use of an annealing atmosphere of higher dew point. The decarburized strips were brushed with milk of magnesia to a weight gain of about 40 milligrams per strip and boron additions were made to some of the magnesia coated strips using a 0.5 percent boric acid solution which deposited sufficient boron on the coating that if it were all taken up by the silicon-iron, the boron content of the metal would be increased by 12 parts per million. The resulting coated strips, including both those brushed with the boric acid solution and those not so treated, were subjected to a final anneal consisting of heating at 40° C per hour from 800° C to 1175° C in dry hydrogen and holding at the latter temperature for 3 hours.

The effects of tin on the permeability and the 60 Hertz losses at 17kB are shown on the chart of FIG. 1 on which permeability at 10H is plotted against percent tin in the melt. Curve A represents the boron-containing coating specimens while Curve B represents those having coatings which were boron-free. The losses in milliwatts per pound are entered adjacent to the corresponding data points on each of the curves. As evident from the data depicted on the chart, the presence of as little as 0.010 percent tin, particularly with boron added to the coating, results in a substantial improvement in magnetic properties. With these alloys essentially the full benefit in this respect of the presence of tin is attained with 0.020 percent.

EXAMPLE II

In another experiment like that of Example I, two laboratory heats were melted in an air induction furnace under an argon cover using electrolytic iron and 98 percent ferrosilicon, both containing 3.1 percent silicon, 10 parts per million boron and 40–50 parts per million nitrogen and otherwise having the compositions stated in Table II.

TABLE II

| Heat | % Mn | % S | % C | % Sn |
|---|---|---|---|---|
| 5 | 0.028 | 0.013 | 0.036 | <0.002 |
| 6 | 0.026 | 0.013 | 0.035 | 0.02 |

Processing from the melt stage to finally annealed condition was as described in Example I except that hot rolling was carried out at five different temperatures and the boron content of the coatings was greater, being equivalent to 15 parts per million on the basis of the substrate silicon-iron sheet or strip material. The permeability values for alloys 5 and 6 are plotted in FIG. 2 when final annealed without a boron addition to the coating, and in FIG. 3 with a boron addition to the coating. The losses in milli-watts per pound are entered adjacent to the corresponding data points on each of the curves representing Heats 5 and 6, as indicated.

Figure 2:
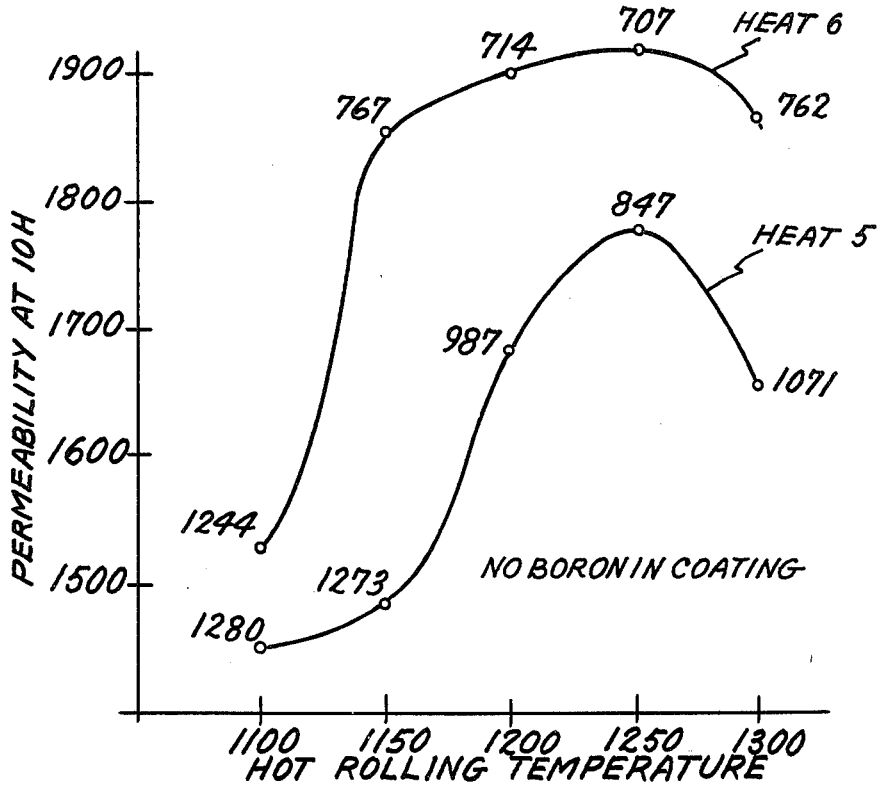
FIG. 2 plots the permeability of two alloys without a boron addition to the coating.
Figure 3:
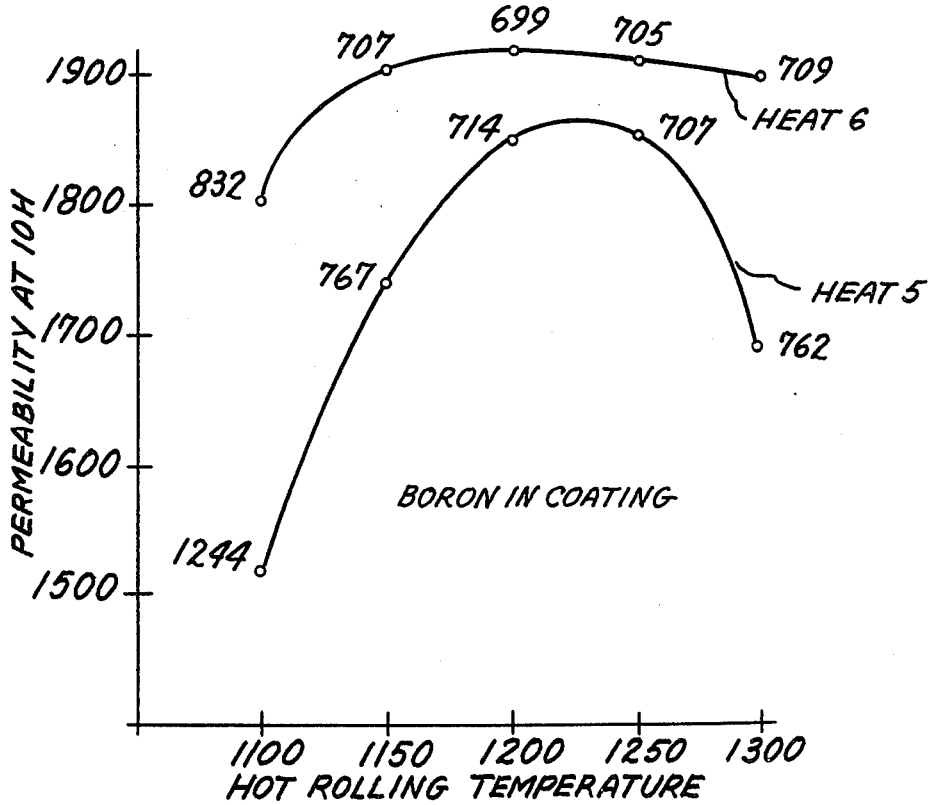
FIG. 3 plots the permeability of the two alloys with a boron addition to the coating.

The superiority of the heat-containing tin is evident from a comparison of the magnetic properties, and particularly the permeabilities, in FIGS. 2 and 3. Even without boron in the coating, the permeability is greater than 1900 or close to 1900 when hot rolled from 1200° C and 1250° C, and with boron in the coating the permeabilities exceed 1900 when rolled from all but the lowest temperature.

EXAMPLE III

In a third experiment like those of Examples I and II, seven heats each containing 3.1 percent silicon, 0.1 percent copper and 0.03 percent chromium were prepared to the compositions stated in Table III.

TABLE III

| Heat | % Mn | % S | % C | ppm B | ppm N | % Sn |
|---|---|---|---|---|---|---|
| 7 | 0.028 | 0.013 | 0.036 | 7 | 43 | <0.002 |
| 8 | 0.026 | 0.013 | 0.035 | 8 | 39 | 0.02 |
| 9 | 0.025 | 0.014 | 0.034 | 6 | 38 | 0.047 |
| 10 | 0.025 | 0.009 | 0.035 | 4 | 38 | <0.002 |
| 11 | 0.025 | 0.009 | 0.035 | 4 | 38 | 0.023 |
| 12 | 0.027 | 0.010 | 0.035 | 5 | 35 | 0.048 |
| 13 | 0.024 | 0.008 | 0.036 | 8 | 36 | 0.097 |

Processing through the final anneal was as set forth in Example I, except that five different hot rolling temperatures were used as set out in Example II. Also, boron was incorporated in some of the magnesia coatings as described in Example II and indicated in Tables IV and V, the boron content of the coating in each instance being equivalent to 12 parts per million on the basis of the substrate silicon-iron sheet or strip material. The magnetic properties of the silicon-iron strip material made and tested in the course of this experiment are set out in Table IV (heats containing 0.013 percent sulfur) and Table V (heats containing 0.009 percent sulfur).

TABLE IV

MAGNETIC PROPERTIES AFTER THE FINAL ANNEAL OF HEATS WITH 0.013% SULFUR

| | Heat 7 | | | | Heat 8 | | | | Heat 9 | | | |
|---|---|---|---|---|---|---|---|---|---|---|---|---|
| | MgO | | MgO+B | | MgO | | MgO+B | | MgO | | MgO+B | |
| Hot Rolling Temp., °C | mwpp 17kB | μ10H | mwpp 17kB | μ10H | mwpp 17kB | μ10H | mwpp 17kB | μ10H | mwpp 17kB | μ10H | mwpp 17kB | μ10H |
| 1100 | 1280 | 1451 | 1218 | 1518 | 1244 | 1530 | 832 | 1808 | 929 | 1732 | 727 | 1878 |
| 1150 | 1273 | 1487 | 874 | 1739 | 767 | 1848 | 707 | 1903 | 788 | 1878 | 720 | 1893 |
| 1200 | 987 | 1680 | 701 | 1856 | 714 | 1894 | 699 | 1924 | 681 | 1920 | 665 | 1932 |
| 1250 | 847 | 1774 | 699 | 1862 | 707 | 1912 | 705 | 1912 | 702 | 1919 | 674 | 1928 |
| 1300 | 1071 | 1657 | 937 | 1696 | 762 | 1859 | 709 | 1907 | 734 | 1912 | 688 | 1920 |

TABLE V

MAGNETIC PROPERTIES AFTER THE FINAL ANNEAL OF HEATS WITH 0.009% SULFUR

| | Heat 10 | | | | Heat 11 | | | |
|---|---|---|---|---|---|---|---|---|
| Hot | MgO | | MgO+B | | MgO | | MgO+B | |
| Rolling Temp., °C | mwpp 17kB | μ10H | mwpp 17kB | μ10H | mwpp 17kB | μ10H | mwpp 17kB | μ10H |
| 1100 | >1300 | 1455 | >1300 | 1471 | >1300 | 1481 | 1162 | 1611 |
| 1150 | >1300 | 1465 | 1258 | 1493 | 1170 | 1623 | 742 | 1844 |
| 1200 | 1285 | 1472 | 1256 | 1515 | 743 | 1855 | 682 | 1892 |
| 1250 | 1226 | 1530 | 1037 | 1648 | 705 | 1888 | 679 | 1898 |
| 1300 | 1292 | 1507 | 906 | 1750 | 923 | 1737 | 735 | 1860 |

| | Heat 12 | | | | Heat 13 | | | |
|---|---|---|---|---|---|---|---|---|
| Hot | Mgo | | MgO+B | | MgO | | MgO+B | |
| Rolling Temp., °C | mwpp 17kB | μ10H | mwpp 17kB | μ10H | mwpp 17kB | μ10H | mwpp 17kB | μ10H |
| 1100 | 1359 | 1507 | 970 | 1701 | — | — | — | — |
| 1150 | 1148 | 1618 | 732 | 1861 | — | — | — | — |
| 1200 | 839 | 1775 | 683 | 1890 | 804 | 1881 | 776 | 1930 |
| 1250 | 789 | 1813 | 678 | 1906 | — | — | — | — |
| 1300 | 1199 | 1589 | 798 | 1812 | — | — | — | — |

EXAMPLE IV

In a fourth experiment like that of Examples I, II and III, 10 heats each containing 3.1 percent silicon, 0.10 percent copper, 0.03 percent chromium, 0.04 percent carbon, 0.035 percent manganese, 5–10 parts per million boron and 35–65 ppm nitrogen were prepared. To five heats 0.05 percent tin was added, whereas no tin was added to the other five heats. Compositions of these heats, as analyzed, and the welding behavior of material produced from them are set out in Table VI.

TABLE VI

| Heat | % Mn | % S | % Sn | Parallel Crack | Transverse Cracks/Meter |
|---|---|---|---|---|---|
| 14 | 0.034 | 0.010 | <0.002 | No | 0 |
| 15 | 0.035 | 0.013 | <0.002 | No | 16 |
| 16 | 0.037 | 0.016 | <0.002 | No | 64 |
| 17 | 0.038 | 0.019 | <0.002 | Yes | 173 |
| 18 | 0.034 | 0.022 | <0.002 | Yes | 192 |
| 19 | 0.034 | 0.010 | 0.045 | No | 4 |
| 20 | 0.035 | 0.013 | 0.040 | No | 37 |
| 21 | 0.032 | 0.015 | 0.046 | No | 65 |
| 22 | 0.036 | 0.017 | 0.045 | No | 75 |
| 23 | 0.035 | 0.019 | 0.049 | — | — |

Table VI indicates that as the sulfur content is increased, the frequency of cracks in the weld increases and with 0.019 percent sulfur or greater, a crack also develops in the weld parallel to its length. The tests yielding these results and leading to the conclusion that the occurrence of cracks in primarily dependent upon sulfur content were carried out through simulated welding which involved running a tungsten electrode (1/16-inch diameter) above (1/32 inch) the surface of a 60-mil thick cold rolled strip specimen clamped in a fixture. With a current of 50 amperes and electrode travel at a rate of eight inches per minute, a molten zone of 100 to 150 mils wide was obtained. After a pass with the electrode, the test specimens fell into three categories:

(1) those with a prominent crack running the length of the weld ("parallel crack" in Table I) and with other small cracks in the weld;

(2) those without a parallel crack but with occasional cracks in and adjacent to the weld oriented at an angle to the weld ("transverse cracks" in Table I); and (3) those free from cracks, which was confirmed by using a dye penetrant in general use for crack detection purposes.

This test exaggerates the tendency for the material to develop cracks, it being anticipated that a material that develops only transverse cracks in the evaluation would be weldable with the proper techniques.

Figure 4:
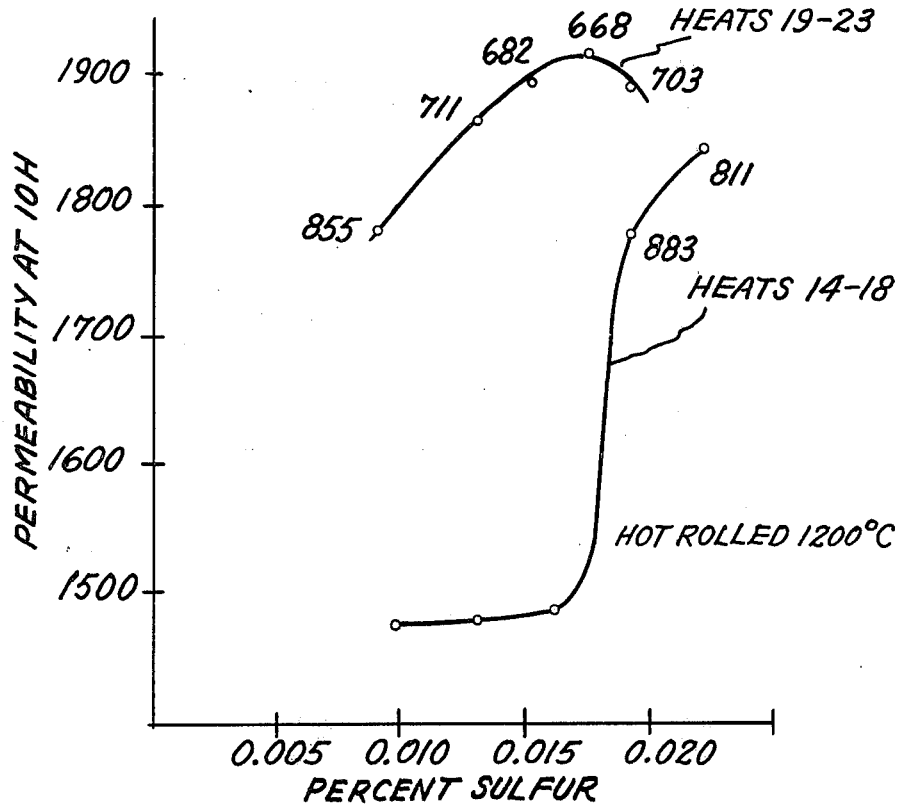
FIG. 4 shows the magnetic properties of 10 heats after a final anneal; 5 of said heats having a tin addition.
Figure 5:
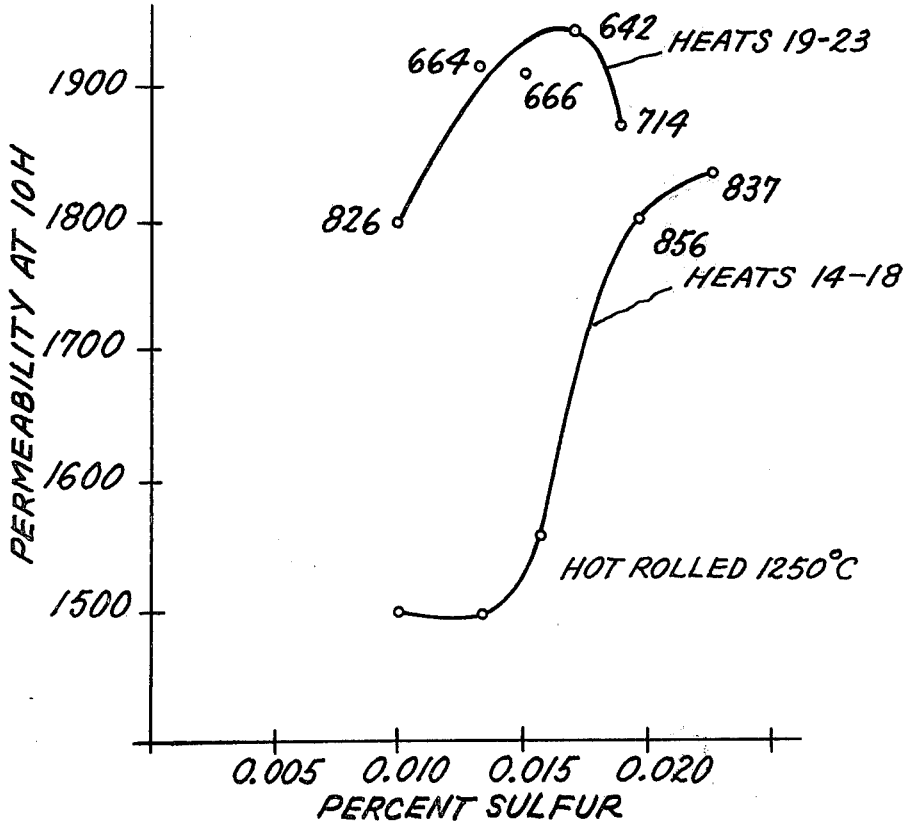
FIG. 5 shows the magnetic properties of 10 heats after a final anneal, 5 of said heats having a tin addition.

In FIGS. 4 and 5 are shown the magnetic properties of the 10 heats after the final anneal. No boron was added to the coating prior to the anneal. Adjacent to the data points are the losses at 17 kilogausses and 60 Hertz. The superior magnetic properties of the heats containing tin are evident. It is apparent from the welding behavior outlined in Table VI and the magnetic properties in FIGS. 4 and 5 that with an addition of tin high permeability and low losses can be achieved in heats sufficiently low in sulfur as not to exhibit a "parallel crack" in the welding evaluation.

What I claim as new and desire to secure by Letters Patent of the United States is:

1. The method of producing grain oriented silicon-iron sheet which comprises the steps of providing a silicon-iron melt containing 2.2 to 4.5 percent silicon, between about three and 35 parts per million boron, between about 30 and 75 parts per million nitrogen in the ratio to boron of 1 to 15 parts per part of boron, from 0.02 to 0.05 percent manganese, 0.005 to 0.025 percent sulfur and tin in amounts ranging from 0.01 to 0.10 percent, casting the melt and hot rolling the resulting billet to form an elongated sheet-like body, cold rolling the hot rolled body to provide a sheet of final gauge thickness, and subjecting the resulting cold-rolled sheet to a final heat treatment to decarburize it and to develop (110) [001] secondary recrystallization texture in it.

2. The method of claim 1 in which the manganese content of the melt is about 0.025 percent, the sulfur content of the melt is about 0.012 percent and the tin content of the melt is between about 0.010 and 0.050 percent.

3. The method of claim 1 in which the melt contains between about 0.02 and 0.03 percent manganese, between about 0.009 and 0.014 percent sulfur and between about 0.020 and 0.050 percent tin.

4. The method of claim 1 in which the melt contains between about 0.030 and 0.040 percent manganese, between about 0.013 and 0.019 percent sulfur and between 0.020 and 0.050 percent tin.

5. The method of claim 1 in which the melt contains about 0.026 percent manganese, about 0.013 percent sulfur and about 0.02 percent tin, and in which in preparation for the final heat treatment step the cold-rolled silicon-iron sheet is provided with an electrically-insulating adherent coating containing about 15 parts per million boron on the basis of the said silicon-iron sheet.

6. The method of claim 1 in which the melt contains about 0.024 percent manganese, about 0.008 percent sulfur and about 0.097 percent tin, and in which in preparation for the final heat treatment step the cold-rolled silicon-iron sheet is provided with an electrically-insulating adherent coating containing about 12 parts per million boron on the basis of the said silicon-iron sheet.

7. A cold-rolled silicon-iron sheet product containing 2.2 to 4.5 percent silicon, between about three and 35 parts per million boron, between about 30 and 75 parts per million nitrogen in the ratio to boron of one to 15 parts per part of boron, from 0.02 to 0.05 percent manganese, 0.005 to 0.025 percent sulfur and tin in amounts ranging from 0.010 to 0.10 percent.

8. The cold-rolled sheet of claim 7 in which the manganese content is about 0.025 percent, the sulfur content is about 0.013 percent, and the tin content is about 0.05 percent.

9. The cold-rolled sheet of claim 7 in which the manganese content is about 0.035 percent, the sulfur content is about 0.017 percent and the tin content is about 0.05 percent.

* * * * *

UNITED STATES PATENT AND TRADEMARK OFFICE

CERTIFICATE OF CORRECTION

PATENT NO. : 4,123,299

DATED : October 31, 1978

INVENTOR(S) : Howard C. Fiedler

It is certified that error appears in the above-identified patent and that said Letters Patent are hereby corrected as shown below:

In the patent, Sheet 1, please correct Item [75] to read as follows:

- [75] Inventor: Howard C. Fiedler, Schenectady, N.Y. -

Please correct item [22] to read as follows:

- [22] Filed: Sep. 29, 1977 -

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*